US006685290B1

(12) United States Patent
Farr et al.

(10) Patent No.: US 6,685,290 B1
(45) Date of Patent: Feb. 3, 2004

(54) PRINTER CONSUMABLE HAVING DATA STORAGE FOR STATIC AND DYNAMIC CALIBRATION DATA, AND METHODS

(75) Inventors: Isaac Farr, Corvallis, OR (US); Shane Shivji, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/354,730

(22) Filed: Jan. 30, 2003

(51) Int. Cl.[7] ..... B41J 2/195; G03G 15/00
(52) U.S. Cl. ..... 347/7; 399/12
(58) Field of Search ..... 399/12; 347/7, 347/14

(56) References Cited

U.S. PATENT DOCUMENTS 6,295,423 B1 * 9/2001 Haines et al. ..... 399/24
6,366,742 B1 * 4/2002 Reihl et al. ..... 399/12
2002/0127021 A1 * 9/2002 Chihara ..... 399/12

* cited by examiner

*Primary Examiner*—Stephen D. Meier
*Assistant Examiner*—Alfred E. Dudding
(74) *Attorney, Agent, or Firm*—Larry Baker

(57) ABSTRACT

Embodiments of the present invention include methods and apparatus for compensating for variations between different ink or toner characteristics, and for variations between sensors, by characterizing the ink or toner and storing one or more static threshold level on printer consumable memory devices during manufacture of the printer consumables. When installed in a printer, a dynamic threshold may be determined based on the static threshold level; the dynamic threshold accounting for variations between sensors and printers. The dynamic threshold may further be stored on the printer consumable memory device.

36 Claims, 8 Drawing Sheets

PRINTER CONSUMABLE HAVING DATA STORAGE FOR STATIC AND DYNAMIC CALIBRATION DATA, AND METHODS

FIELD OF INVENTION

The present invention relates generally to printer consumables, and more specifically to memory components on printer consumables, and methods of utilizing information stored therein.

BACKGROUND OF THE INVENTION

Printers with user-replaceable consumables (and related devices, such as facsimile machines and copiers) are well known in the art. For example, inkjet printers typically utilize replaceable ink supplies, either integrated with a printhead or in the form of separate supplies. When separate ink supplies are used in an inkjet printer system, typically the printheads are also separately replaceable and may also be considered a "consumable." In laser printers, toner is typically supplied in a replaceable cartridge, which may include the photosensitive drum on which images are formed.

Typically, printer systems include sensors to monitor conditions in the printer. For example, in inkjet printers, sensors may be used to detect characteristics of the ink and conditions such as a low or empty ink supply. The sensors are typically connected to an electronic controller in the printer, and allow the printer controller to modify the operation of the printer or to notify an operator of the printer status. The sensors may function by detecting a physical, optical, or chemical characteristic of the ink or toner, such as impedance or opacity. The printer controller or the driver software may adjust the operation of the printer based on comparing a measured sensor value to a reference threshold level that may be "hard coded" into the printer controller firmware or the print driver software.

In situations where the printer controller must make a decision based on a comparison of a sensor measurement to a hard coded threshold value, several factors can lead to inaccurate results. First, the consumable material (such as ink) in different replaceable consumables may have different physical or chemical properties. The different properties may be the result of the different consumable materials being formulated for different applications, such as printing on different media. Sensor readings may therefore vary due to the ink characteristics rather than changes in the parameter that the sensor is intended to monitor. For example, different inks may have significantly different impedance characteristics, causing an impedance-based ink level detector or out-of-ink sensor to provide an inaccurate indication.

Second, variations between printers, and within one printer over time, may affect accuracy. Normal component tolerances in sensors and measurement circuitry and changes over lifetime can result in variations between printers, and changes in environmental variables, such as temperature, can cause measurement errors.

The problem of inaccurate or unreliable sensor readings is more acute in situations where the printer controller must distinguish between more than two discrete levels, such as when an inkjet printer controller must determine whether a portion of the ink delivery system contains ink, air, or "froth" (a mixture of ink and air).

There is therefore a need for methods and apparatus that allow sensor threshold levels in printers to be adjusted for different ink or toner characteristics, and for variations between different sensors and printers.

SUMMARY OF THE INVENTION

Embodiments of the present invention include methods and apparatus for compensating for variations between different ink or toner characteristics, and for variations between sensors, by characterizing the ink or toner and storing one or more static threshold level on printer consumable memory devices during manufacture of the printer consumables. When installed in a printer, dynamic thresholds may be determined based on the static threshold level; the dynamic thresholds accounting for variations between sensors and printers. The dynamic thresholds may further be stored on the printer consumable memory devices.

Other aspects and advantages of the present invention will become apparent from the following detailed description, taken in conjunction with the accompanying drawings, illustrating by way of example the principles of the invention.

DESCRIPTION OF THE EMBODIMENTS OF THE INVENTION

Embodiments of the invention will be described with respect to an exemplary inkjet printing system; however, the invention is not limited to printers of the type illustrated, but may be utilized in any type of printer system having user replaceable consumables.

Figure 1:
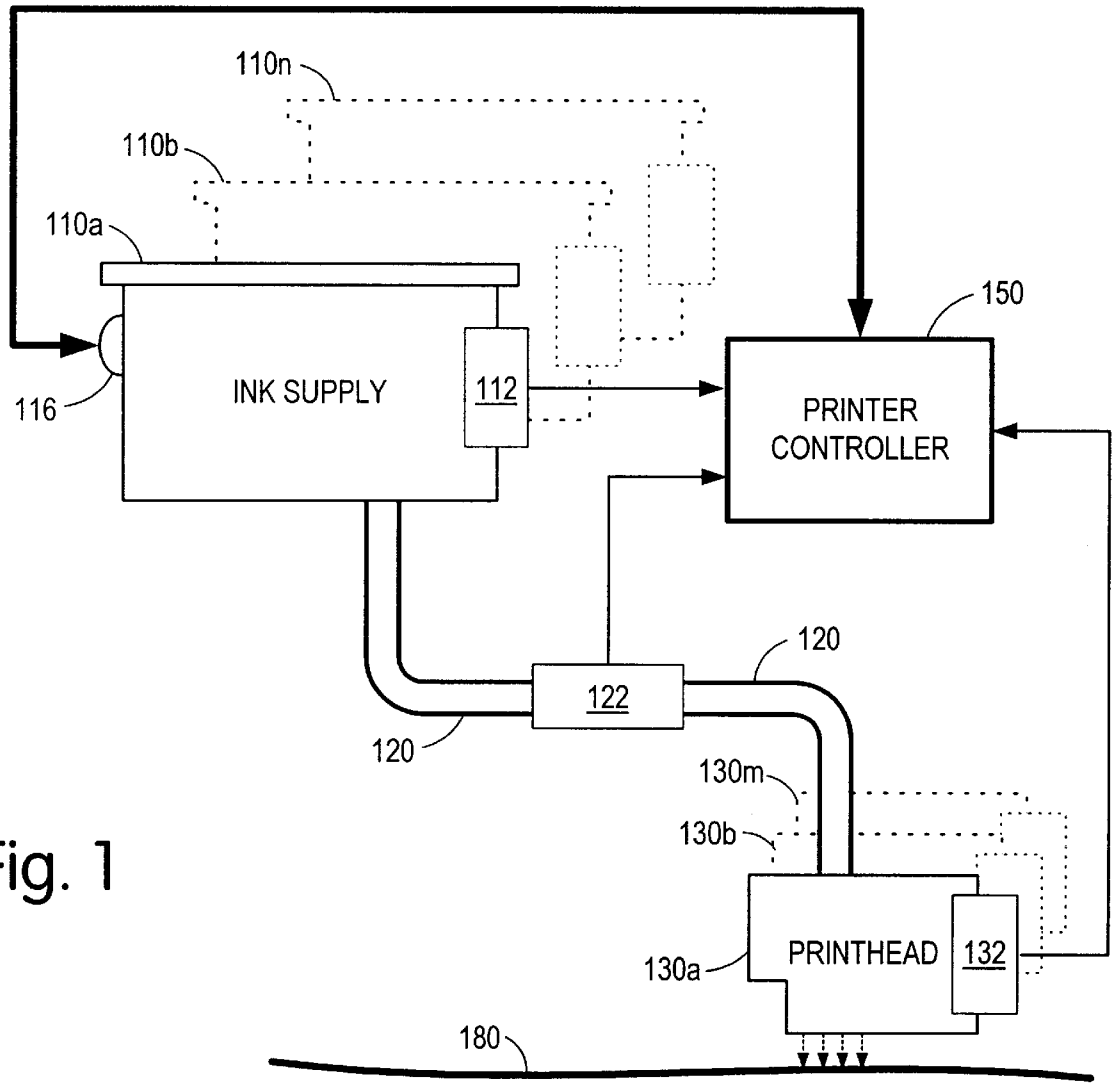
FIG. 1 is block diagram of an exemplary printer system illustrating how a controller may receive signals from sensors located on or near the ink supplies, ink delivery system, and printheads.

FIG. 1 is a block diagram of an exemplary inkjet printing system illustrating how a printer controller may receive signals from sensors on or near the ink supplies, the ink delivery system, and the printheads. Ink supply 110*a* may have one or more associated sensor 112 within the ink supply, mounted on the ink supply, or placed in the printer in the vicinity of the ink supply. The sensor may for example sense the ink level in the supply by an impedance measurement, or optically. The ink supply has an associated memory device 116, as explained below. Typically the memory device is of the type which retains information in the absence of applied power, such as an electrically erasable programmable read only memory (EEPROM), or a non-volatile random access memory (NVRAM). Other types of electronic memory are also suitable, such as a random-access-memory (RAM) with a battery. There may be multiple ink supplies in the printing system, as denoted by supplies 110*b* and 110*n*, and each supply may have an associated memory device and one or more associated sensors.

The exemplary printing system depicted in FIG. 1 is an "off axis" printing system, in which the ink supplies and printheads are separately replaceable and ink is routed from the ink supplies to the printheads through an ink delivery system 120, although the present invention may also be applied in systems in which the printheads are integral with the ink supplies. The ink delivery system may have one or more associated sensor 122. The sensor may for example sense the presence of ink within an ink tube by an impedance measurement or optically. The ink delivery system 120 provides ink to one or more printheads 130*a*, 130*b*, 130*m*, which may differ in number from the number of ink supplies. A sensor 132 may be associated with each printhead. The printheads eject ink onto print media 180 to form text or images.

A printer controller 150 may receive sensor signals from any of the sensors 112,122,132. The printer controller also communicates with a memory device 116 associated with the ink container, as explained below. The printheads may also include memory devices (not shown) in communication with the printer controller.

Figure 2:
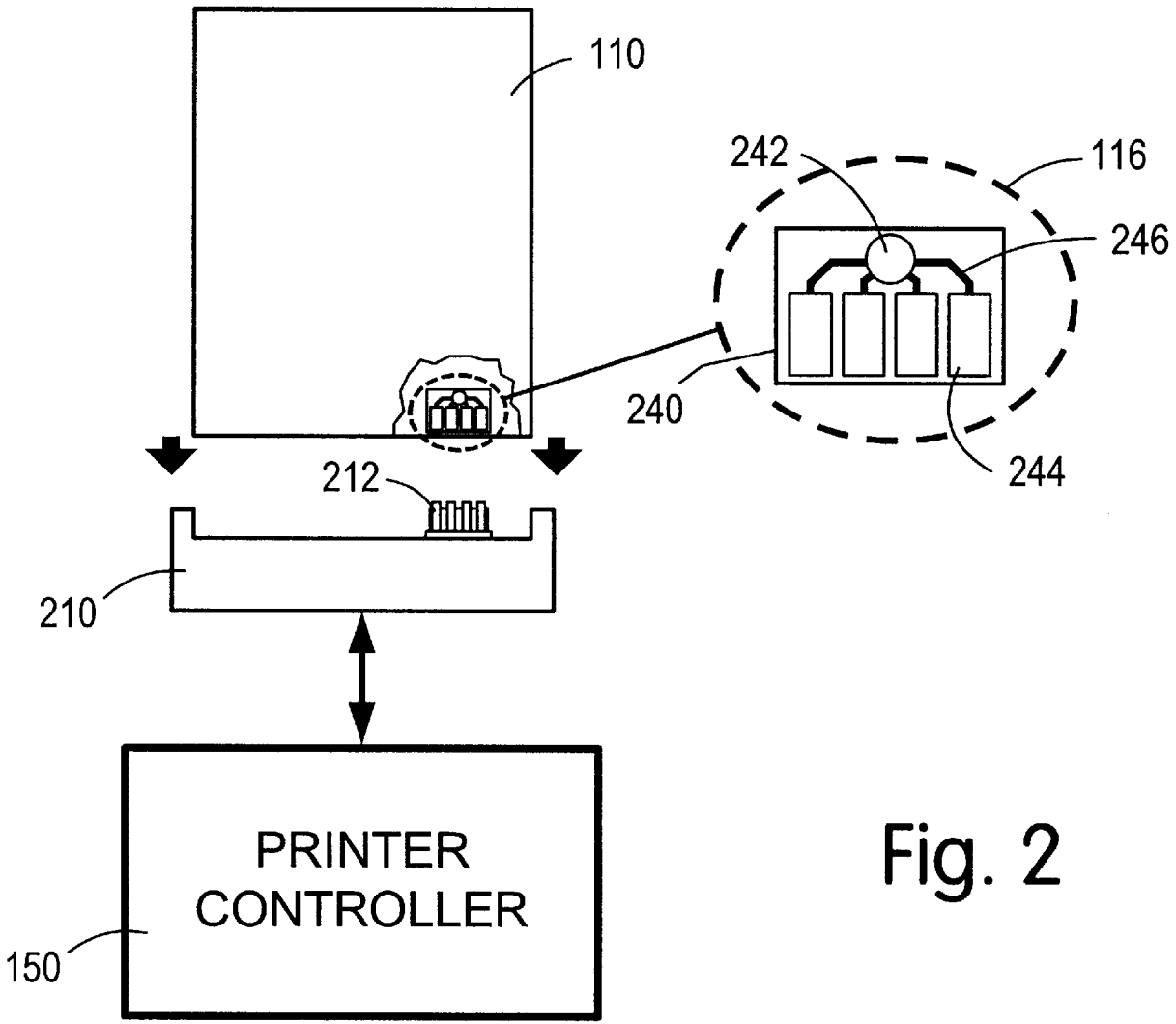
FIG. 2 illustrates an embodiment of a memory device used to store threshold information and other data on a printer consumable.

FIG. 2 illustrates in greater detail one exemplary embodiment of a replaceable printing component, such as an inkjet cartridge, with a memory device or memory component 116. In the embodiment of FIG. 2, the memory component includes electrical contacts for mating with an external electrical connector. The memory component 116 of the exemplary embodiment is formed as a small printed circuit assembly 240, with a plurality of printed electrical contacts 244 for mating with an external connector 212. Printed wiring 246 on the printed circuit assembly provides electrical communication between the electrical contacts and integrated circuit memory 242, which in the exemplary embodiment is encapsulated in a protective material such as epoxy.

The integrated circuit memory 242 of the exemplary embodiment may be a serial input/output memory, as are well known in the art. Such memories may have an asynchronous serial data interface, requiring only a single electrical data lead, plus a case ground return, for data input and output. Data input and output from the one wire memory is accomplished via a protocol wherein various length pulses are employed which evidence the beginning of a read/write action. Those pulses are followed by bit-by-bit transfers, wherein ones and zeros are manifest by different pulse lengths. Alternatively, the memories may have a synchronous serial interface including a clock line. Other serial input/output memories may also used with the present invention, as well as other, non-serial memory configurations.

U.S. Pat. No. 5,699,091 entitled "Replaceable Part With Integral Memory For Usage, Calibration And Other Data" assigned to the assignee of the present invention, further describes the use and operation of such a memory device. As described in the 5,699,091 patent, the memory device may be utilized to allow a printer to access replaceable part parameters to insure high print quality. By incorporating the memory device into the replaceable part and storing replaceable part parameters in the memory device within the replaceable component, the printing system is able to automatically update the parameters upon installation of the part into the printing system. This automatic updating of printer parameters frees the user from having to update printer parameters each time a replaceable component is newly installed. In addition to allowing the printer to optimize print quality, the memory is used to prevent inadvertent damage to the printer resulting from improper operation, such as operating after the supply of ink is exhausted or operating with the wrong or non-compatible printer components, and to store information relating to remaining ink or toner level.

When installed in the printer, the ink container 110 (or other printer consumable) with the memory component 116 is mated to a receiving station 210, which may form part of the carriage of an inkjet printer. The ink container and receiving station may include other interconnections, such as other electrical connections or fluid connections, or electrical connections for sensors (not shown in FIG. 2). The receiving station in turn is in data communication with printer controller 150, which allows reading of the data in the memory component, typically under the control of printer controller firmware.

Figure 3:
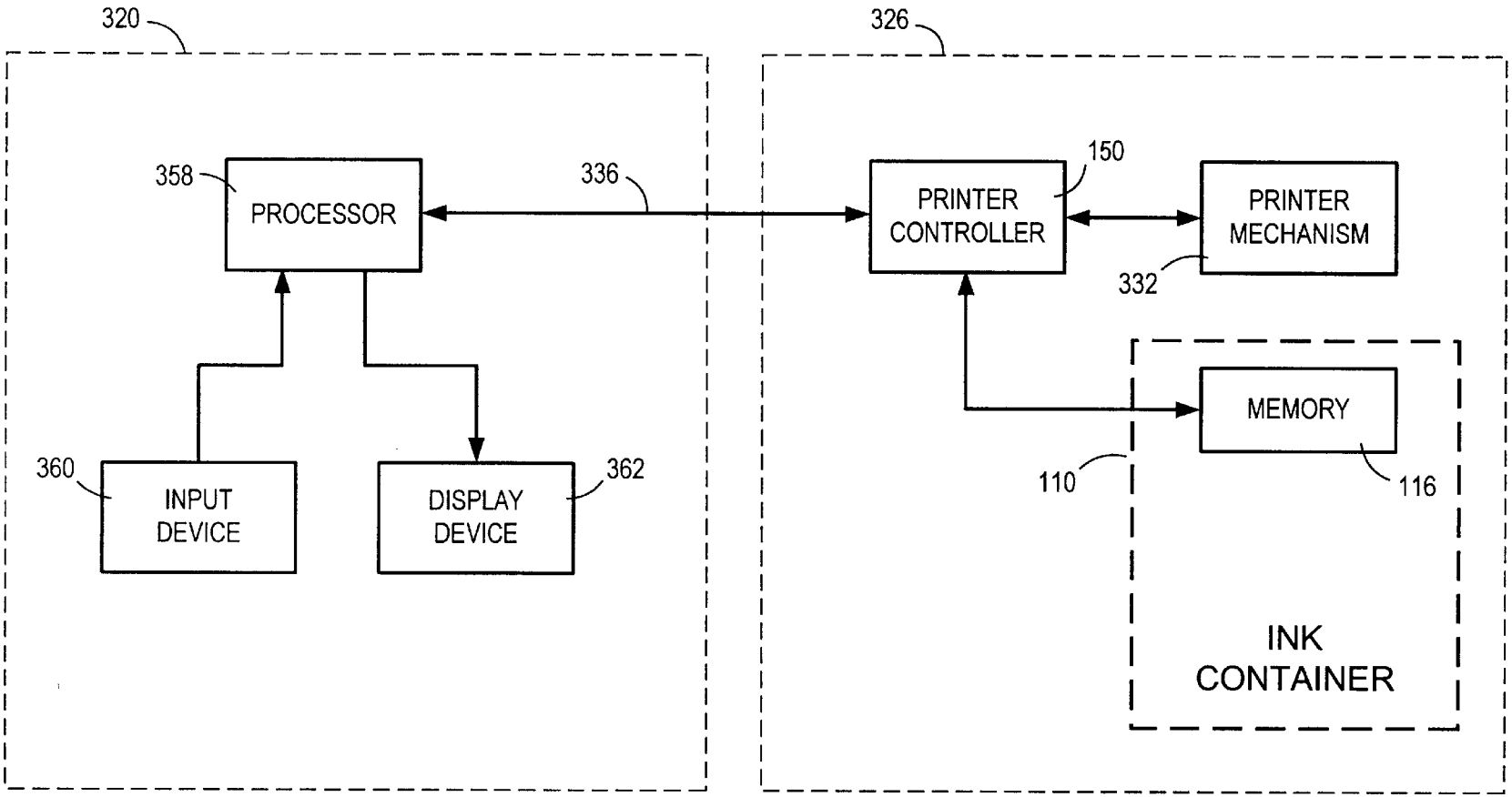
FIG. 3 is a block diagram illustrating how the memory device of FIG. 2 is accessed when the consumable is installed in a printer system.

FIG. 3 is a block diagram further illustrating the electrical interconnections in an exemplary printer system utilizing the memory device of FIG. 2. Typically, the inkjet printer 326 includes a printer controller 150 that is in electrical communication with the mechanical printer mechanism 332. In the present invention, the printer controller is also in electrical communication with the memory component 116 on the consumable 110 (for clarity, electrical connections between the controller and various sensors are not shown). In the present invention, the electrical communication between the printer controller 150 and the memory component 116 are bidirectional, with the controller having the capacity to alter at least some of the memory contents.

Typically the printer 326 is electrically connected to processing equipment 320 over a printer data link 336. The processing equipment generally is a computer processor 358 which is connected to one or more input device 360 and a display device 362.

Figure 4:
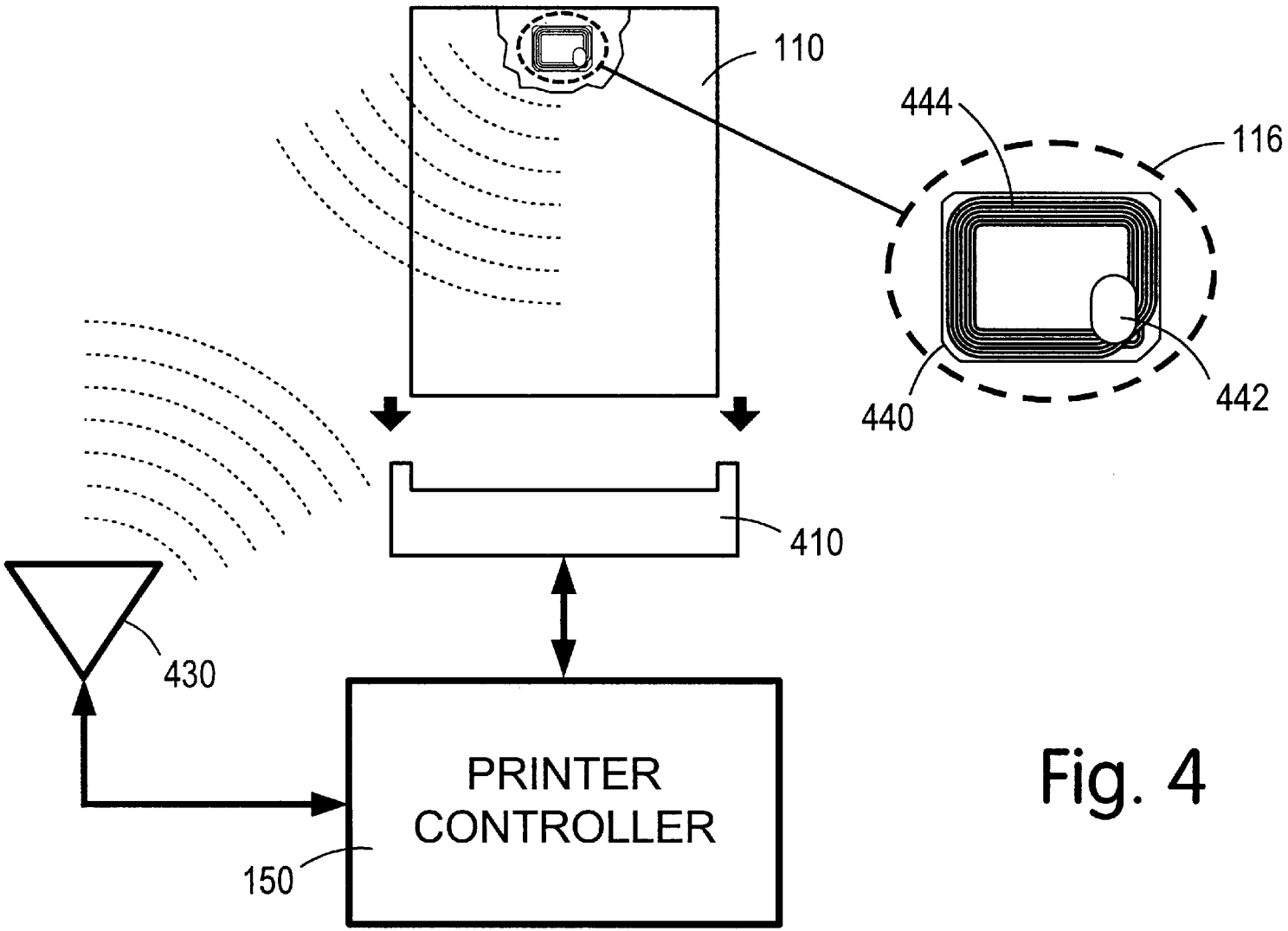
FIG. 4 illustrates another embodiment of a memory device used to store threshold information and other data on a printer consumable.

FIG. 4 illustrates another embodiment of the memory component, in which a wireless data link is used for communicating with the memory component. The memory component 116 comprises an integrated circuit 442 which is die bonded and wire bonded to a substrate 440, and then encapsulated in epoxy. A printed circuit antenna 444 is formed on the substrate to receive data and power and to transmit data. When installed in the printer, the ink container 110 (or other printer consumable) with the memory component 116 is mated to a receiving station 410, such as the carriage of an inkjet printer. The consumable item and receiving station may include other interconnections, such as electrical connections or fluid connections. In the embodiment of FIG. 4, communication between the controller 150 and the memory component 116 is through a wireless data link 430, which allows reading and writing of the data in the memory component 116.

Figure 5:
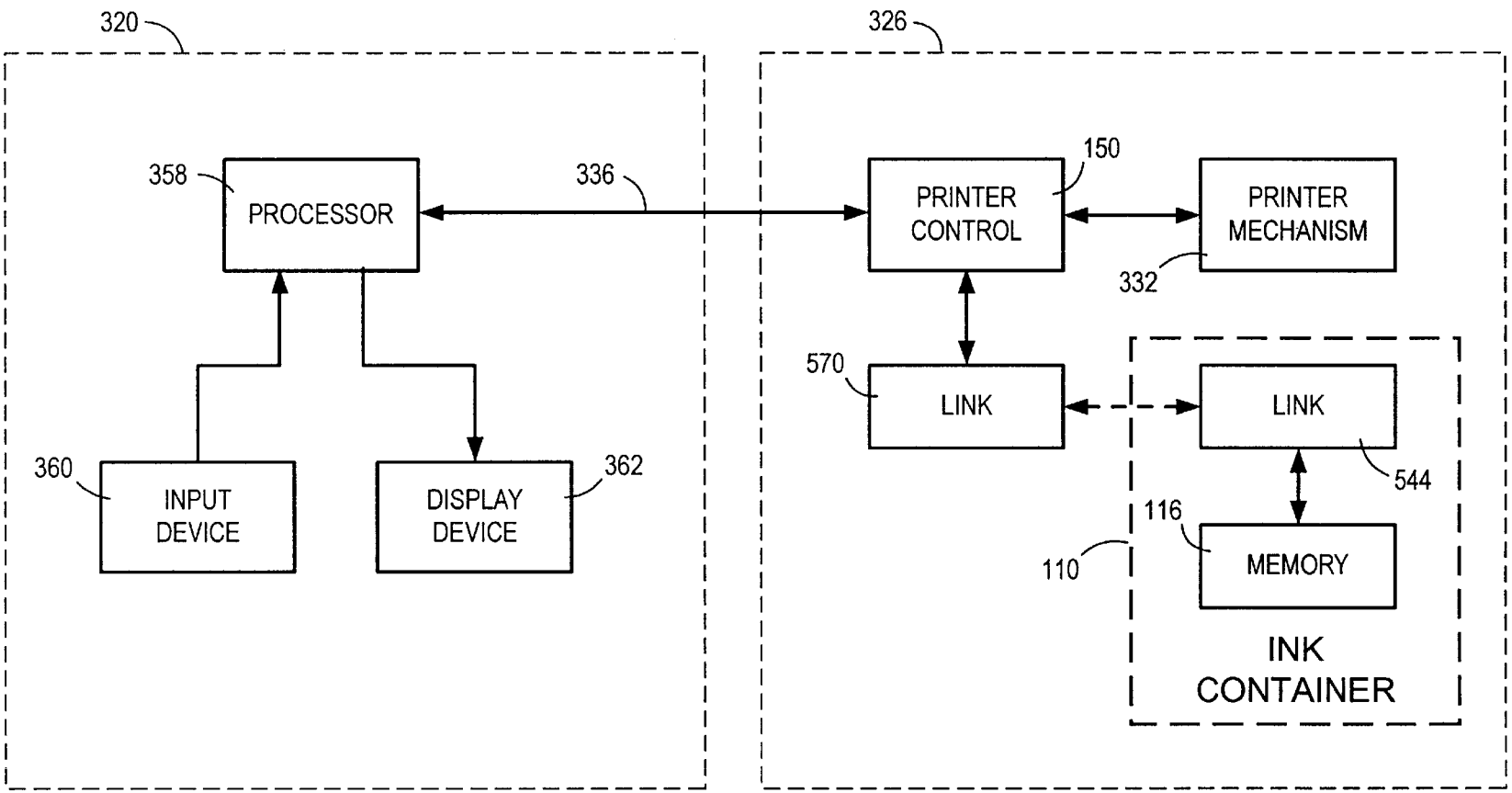
FIG. 5 is a block diagram illustrating how the memory device of FIG. 4 is accessed when the consumable is installed in a printer system.

FIG. 5 is a block diagram further illustrating the electrical interconnections in the exemplary case of an inkjet printer and ink container utilizing a wireless data link. The printing system 326 includes the linking device 570; an associated linking device 544 is contained on consumable 110. The links 570 and 544 allow information to be transferred between the consumable and the printing system 326 without direct electrical contact.

Figure 6:
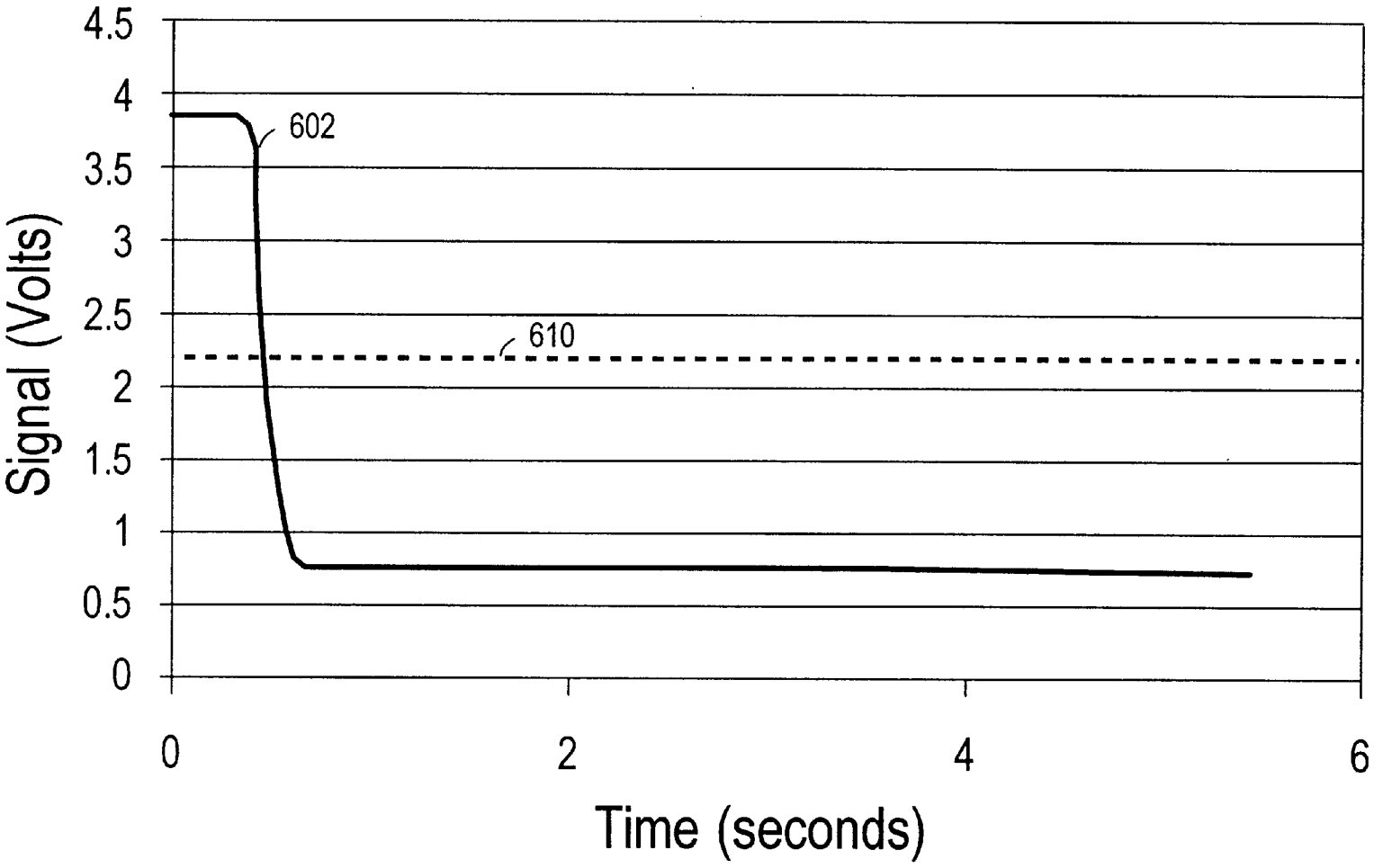
FIG. 6 is an example of how a static threshold level for a physical, chemical, or optical characteristic of ink or toner may be determined for storage in a consumable memory device.
Figure 7:
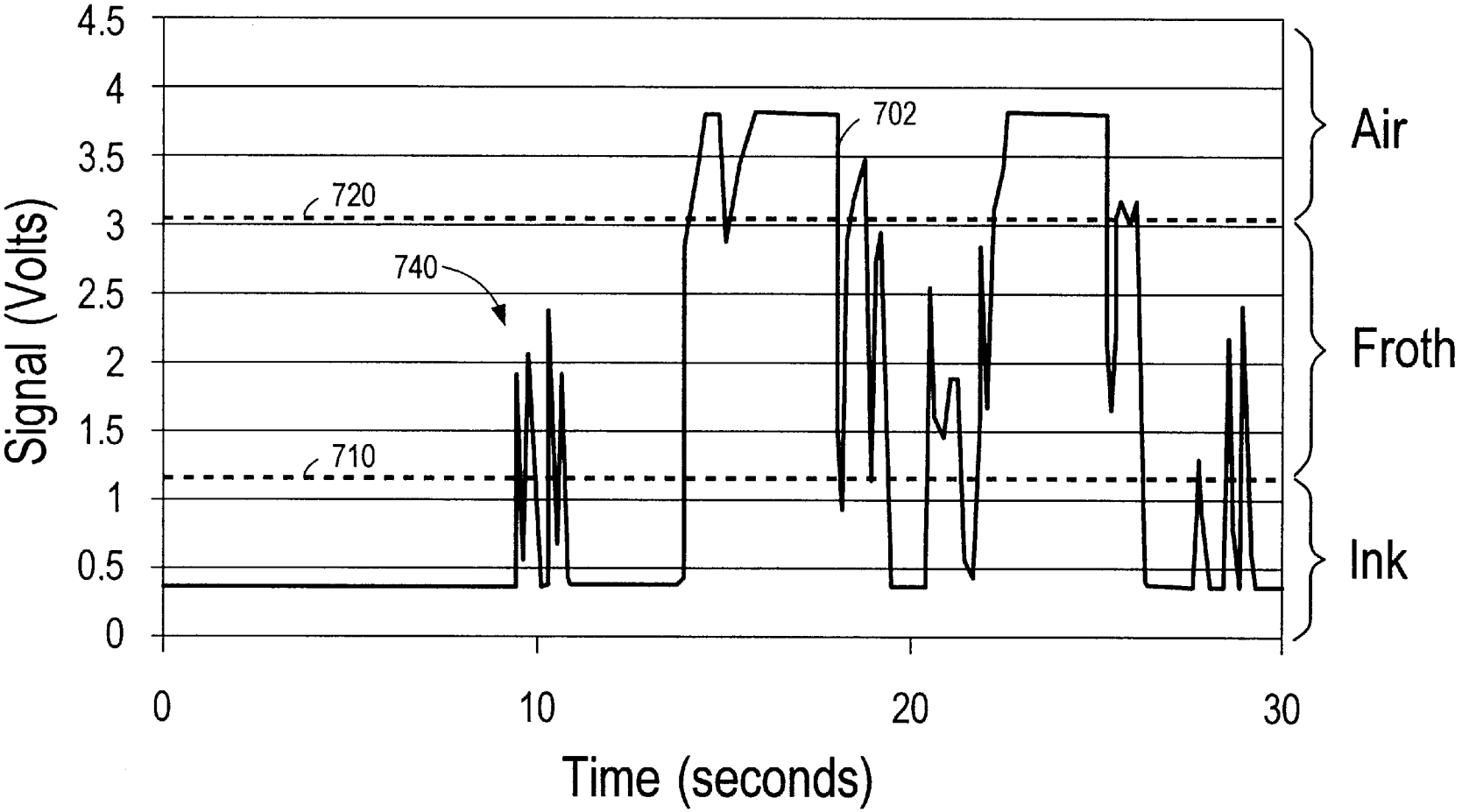
FIG. 7 is an example of how one or more dynamic threshold level for a physical, chemical, or optical characteristic of ink or toner may be determined.

FIGS. 6 and 7 illustrate an exemplary embodiment of the method of the present invention. Turning first to FIG. 7, a hypothetical plot of sensor readings versus time is shown. The sensor readings may represent, for example, the output of an impedance sensor placed in the ink delivery system of the printer to determine whether that portion of the ink delivery system contains, air, ink or froth (a mixture of air and ink). Ideally, the printer controller compares the sensor measurements 702 to threshold values 710, 720 to determine whether ink, air or froth is present ("ink" if the sensor reading is less than lower threshold 710; "air" if the sensor reading is above upper threshold 720; and "froth" if the sensor reading falls between the two thresholds).

If, however, the impedance characteristics of the ink are unknown, the controller may not be able to accurately distinguish between ink, air, or froth. For example, assume that an ink container has been newly installed in the printer and the controller receives the sequence of sensor signals 740 shown in FIG. 7 in the vicinity of 10 seconds. Since the container may contain ink with unknown characteristics, the controller may be unable to determine whether the sequence of signals 740 represent a fluctuation between ink and froth produced by an ink which generates a large sensor response, or a fluctuation between ink and air produced by an ink which generates a small sensor response. A similar problem would exist for other types of fluctuating signals, particularly if the parameter being sensed had both gain and offset components, or a more complex response curve.

To address this problem, the present invention contemplates characterizing the contents of a replaceable consumable at the time of manufacture and storing a static calibration or reference value on the ink container memory component, as demonstrated in FIG. 6. As shown in FIG. 6, a sensor having a response substantially similar to the sensors in the printer system may be used to perform a calibration measurement sequence 602 of the consumable substance, and to determine a static calibration or reference value 610 based on the calibration measurement sequence. Alternatively, multiple static calibration values may be stored on the memory component, such as, for example, a pair of values representing an "ink" measurement and an "air" measurement, values representing gain and offset, or tabular data representing a more fully characterized response.

Referring again to FIG. 7, the hypothetical output of a sensor is depicted, such as might be utilized to distinguish between ink, air, and froth in an ink delivery system. Distinguishing between the three states requires establishment of an ink/froth threshold 710 and a froth/ink threshold 720. Accurate values for these thresholds must into account both the characteristics of the specific ink in the container and variations between sensors. Establishing the thresholds involves storing ink calibration data on the container memory device at the time of manufacture; retrieving the static information after the container is installed in a printer; and determining the actual dynamic threshold levels utilizing the static information and readings from the sensor.

The static ink calibration data stored in the consumable memory device during manufacture may take many different forms, provided that the data conveys sufficient information to the printer controller (or the computer controlling the computer) such that the sensor readings may be appropriately interpreted. For example, the data may be in the form of approximate threshold levels or gain and offset values.

The dynamic calibration may be performed on an "as needed" basis as sensor readings are made, or may be part of a calibration routine, with the results stored in local memory within the printer, in memory or on semipermanent storage (such as a hard drive) in a computer attached to the printer.

Other techniques for dynamically calibrating the sensors may also be used. For example, in the exemplary case of an air, ink, and froth sensor as shown in FIG. 7, the static data may take the form of an approximate threshold value designating ink or air, and a standard deviation value. In determining the dynamic thresholds, the controller would take a sequence of readings and calculate a standard deviation for the readings; a calculated standard deviation less than the stored value would indicate that the sensor was detecting either ink or air, since it has been empirically determined that a sequence of froth readings yield a high standard deviation.

The determination of dynamic thresholds may involve more complex determinations by the printer controller or the printer driver software of processing equipment connected to the printer. For example, a series of sensor readings may be taken and a statistical analysis performed to determine a threshold level, or the determination may take into account readings from multiple sensors, such as adjusting a threshold ink/air value based on readings from a temperature sensor. The determination may also include other information locally available to the printer system or connected computer system, such as information characterizing the particular printer or printer family stored in printer firmware, or in the driver software.

One or more dynamic threshold level may be calculated for each sensor in the system related to the replaceable consumable, such as when multiple ink/air sensors are placed in the ink delivery path. Dynamic thresholds may be saved in memory related to the printer controller or in the memory of processing equipment (such as a computer) connected to the printer. Alternatively, the dynamic thresholds may be stored in the memory device on the consumable.

Figure 8:
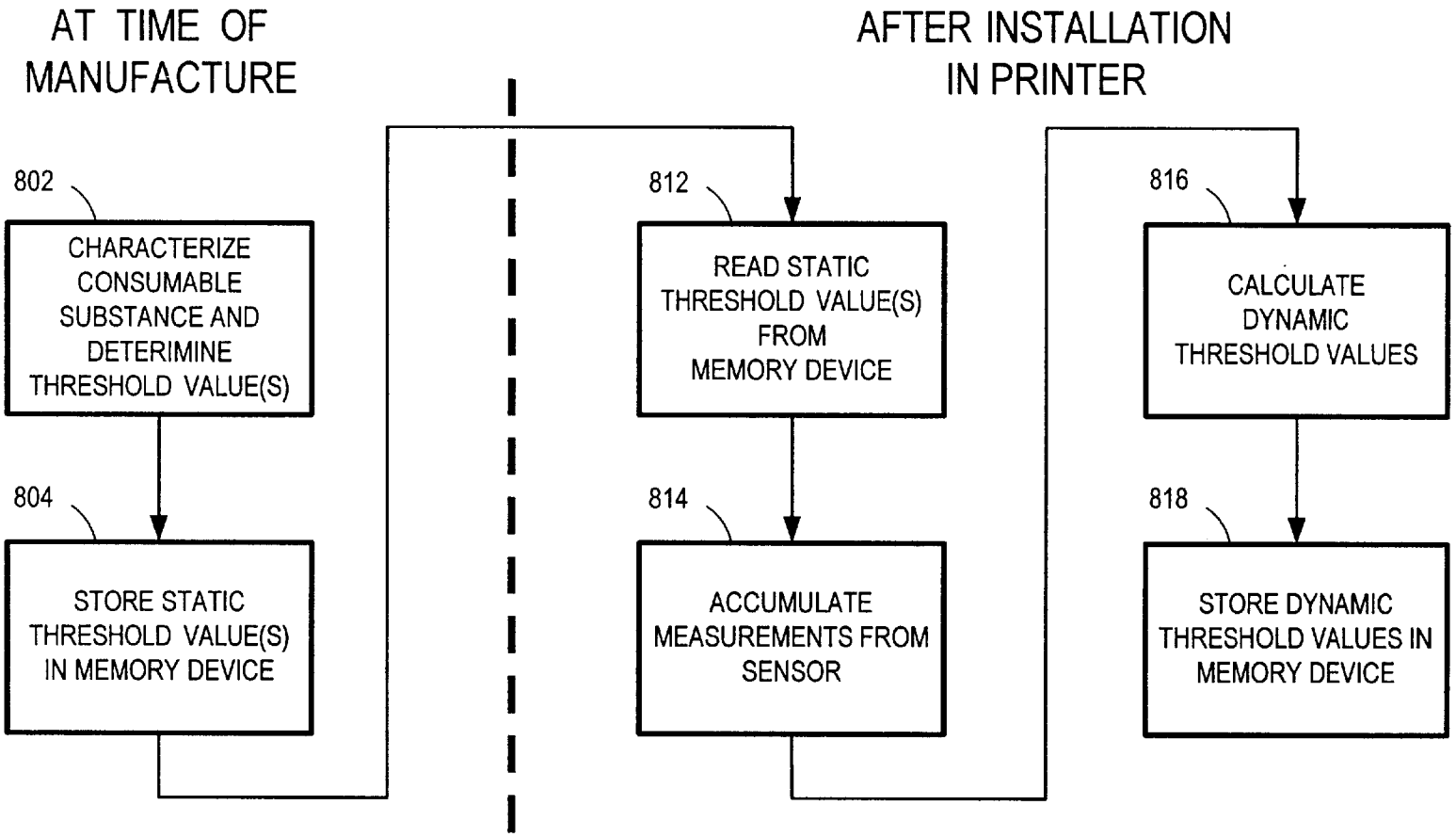
FIG. 8 is a flow chart summarizing an embodiment of the present invention.

FIG. 8 summarizes in block diagram form exemplary methods of the present invention. At the time of manufacture of a printer consumable, a determination 802 is made of static calibration or threshold data, which is then stored 804 in the memory device of the replaceable consumable. When the consumable is later installed in a printer system, the static calibration data is retrieved 812 from the memory device. Based on the one or more stored static calibration levels, the printer controller (or a computer or processor attached to the printer) determines 816 dynamic threshold levels. The determination of dynamic threshold levels may be performed separately for each sensor associated with a consumable, may involve analysis of multiple sensor readings, or may utilize readings from more than one sensor.

The dynamic threshold levels may be determined as needed by the controller or computer; may be saved in a local memory by the printer controller or computer; or may be written 818 to locations in the memory device on the consumable.

While the discussion of the exemplary embodiments refers to "threshold" and "reference" levels for sensors, it is understood that the invention includes other forms of calibrating or adjusting the operation of printing systems, such as The above is a detailed description of particular embodiments of the invention. It is recognized that departures from the disclosed embodiments may be within the scope of this invention and that obvious modifications will occur to a person skilled in the art. It is the intent of the applicant that the invention include alternative implementations known in the art that perform the same functions as those disclosed. This specification should not be construed to unduly narrow the full scope of protection to which the invention is entitled.

The corresponding structures, materials, acts, and equivalents of all means or step plus function elements in the claims below are intended to include any structure, material, or acts for performing the functions in combination with other claimed elements as specifically claimed.

What is claimed is:

1. A method of setting a sensor threshold level in a printing system, the sensor detecting a characteristic of a consumable substance utilized by the printing system, comprising:

during manufacture of a replaceable container of the consumable substance, characterizing the consumable substance to determine a static calibration value;

storing a value representing the static calibration value in an electronic memory component on the replaceable container; and after installation of the container of the consumable substance in a printing system, retrieving the value representing the static calibration value from the electronic memory component; and determining a dynamic threshold level based on the static calibration value and signals from the printer system sensor.

2. The method of setting a sensor threshold level in a printing system of claim 1, wherein the replaceable container of the consumable substance comprises an inkjet cartridge.

3. The method of setting a sensor threshold level in a printing system of claim 1, wherein the replaceable container of the consumable substance comprises a laser toner cartridge.

4. The method of setting a sensor threshold level in a printing system of claim 1, wherein the electronic memory component comprises an electrically erasable programmable read-only-memory.

5. The method of setting a sensor threshold level in a printing system of claim 1, wherein the electronic memory component comprises a nonvolatile random access memory.

6. The method of setting a sensor threshold level in a printer system of claim 1, wherein container of the consumable substance further comprises electrical contacts for electrically accessing the electronic memory component.

7. The method of setting a sensor threshold level in a printer system of claim 1, wherein container of the consumable substance further comprises a wireless data link for electrically accessing the electronic memory component.

8. The method of setting a sensor threshold level in a printing system of claim 1, wherein the printer system sensor comprises an impedance sensor.

9. The method of setting a sensor threshold level in a printing system of claim 8, wherein the printer is an inkjet printer and the sensor distinguishes between ink, air, and froth.

10. The method of setting a sensor threshold level in a printing system of claim 9, wherein the static calibration value comprises a value indicative of the standard deviation of sensor measurements when detecting substantially pure ink or substantially pure air.

11. The method of setting a sensor threshold level in a printing system of claim 1 further comprising storing data representing the dynamic threshold level in the electronic memory component.

12. The method of setting a sensor threshold level in a printing system of claim 1, wherein determining a dynamic threshold level based on the static calibration value and signals from the printer system sensor further comprises accumulating a sequence of sensor readings and statistically processing the readings.

13. The method of setting a sensor threshold level in a printing system of claim 1, wherein determining a dynamic threshold level based on the static calibration value and signals from the printer system sensor further comprises adjusting the threshold level based on stored data characterizing the sensor.

14. A method of dynamically calibrating a printing system to compensate for variability in a characteristic of a consumable substance, the printing system utilizing replaceable containers of the consumable substance, comprising:

during manufacture of a replaceable container of the consumable substance, characterizing the consumable substance to determine static calibration information;

storing calibration information in an electronic memory component on the replaceable container; and after installation of the container of the consumable substance in a printing system, retrieving the calibration information from the electronic memory component; and dynamically calibrating the printing system based on the static calibration information and information locally available to the printing system.

15. The method of dynamically calibrating a printing system to compensate for variability in a characteristic of a consumable substance of claim 14, wherein the replaceable container of the consumable substance comprises an inkjet cartridge.

16. The method of dynamically calibrating a printing system to compensate for variability in a characteristic of a consumable substance of claim 14, wherein the replaceable container of the consumable substance comprises a laser toner cartridge.

17. The method of dynamically calibrating a printing system to compensate for variability in a characteristic of a consumable substance of claim 14, wherein the electronic memory component comprises an electrically erasable programmable read-only-memory.

18. The method of dynamically calibrating a printing system to compensate for variability in a characteristic of a consumable substance of claim 14, wherein the electronic memory component comprises a non-volatile random access memory.

19. The method of dynamically calibrating a printing system to compensate for variability in a characteristic of a consumable substance of claim 14, wherein container of the consumable substance further comprises electrical contacts for electrically accessing the electronic memory component.

20. The method of dynamically calibrating a printing system to compensate for variability in a characteristic of a consumable substance of claim 14, wherein container of the consumable substance further comprises a wireless data link for electrically accessing the electronic memory component.

21. The method of dynamically calibrating a printing system to compensate for variability in a characteristic of a consumable substance of claim 14, wherein the printer system further comprises an impedance sensor.

22. The method dynamically calibrating a printing system to compensate for variability in a characteristic of a consumable substance of claim 21, wherein the printer is an inkjet printer and the sensor distinguishes between ink, air, and froth.

23. The method of dynamically calibrating a printing system to compensate for variability in a characteristic of a consumable substance of claim 22, wherein the static calibration value comprises a value indicative of the standard deviation of sensor measurements when detecting substantially pure ink or substantially pure air.

24. The method of dynamically calibrating a printing system to compensate for variability in a characteristic of a consumable substance of claim 14 further comprising storing data representing the dynamic calibration information in the electronic memory component.

25. The method of dynamically calibrating a printing system to compensate for variability in a characteristic of a consumable substance of claim 14, wherein dynamically calibrating the printing system based on the static calibration information and information locally available to the printing system further comprises accumulating a sequence of sensor readings and statistically processing the readings.

26. The method of dynamically calibrating a printing system to compensate for variability in a characteristic of a consumable substance of claim 14, wherein dynamically calibrating the printing system based on the static calibration information and information locally available to the printing system further comprises adjusting the threshold level based on stored data characterizing the sensor.

27. A consumable for a printer system, comprising:

a container for a consumable substance;

an electronic memory component, the electronic memory component having first stored calibration data relating to a characteristic of the consumable substance, the electronic memory component further having second stored calibration data derived from the first calibration data, the second calibration data relating to a threshold level for an individual printer sensor.

28. The consumable for a printer system of claim 27, wherein the container for a consumable substance comprises an inkjet cartridge.

29. The consumable for a printer system of claim 27, wherein the container for a consumable substance comprises a laser toner cartridge.

30. The consumable for a printer system of claim 27, wherein the electronic memory component comprises an electrically erasable programmable read-only-memory.

31. The consumable for a printer system of claim 27, wherein the electronic memory component comprises a non-volatile random access memory.

32. The consumable for a printer system of claim 27, wherein container for a consumable substance further comprises electrical contacts for electrically accessing the electronic memory component.

33. The consumable for a printer system of claim 27, wherein container for a consumable substance further comprises a wireless data link for electrically accessing the electronic memory component.

34. The consumable for a printer system of claim 27, wherein the first stored calibration data relating to a characteristic of the consumable substance comprises a characterization of the impedance of a consumable substance.

35. The consumable for a printer system of claim 34, wherein the consumable substance comprises ink.

36. The consumable for a printer system of claim 35, wherein the static calibration value comprises a value indicative of the standard deviation of sensor measurements when detecting substantially pure ink.

* * * * *